US011732853B2

(12) United States Patent
Wu et al.

(10) Patent No.: US 11,732,853 B2
(45) Date of Patent: Aug. 22, 2023

(54) UNDERGROUND LAMP

(71) Applicants: OPPLE LIGHTING CO., LTD., Shanghai (CN); SUZHOU OPPLE LIGHTING CO., LTD., Suzhou (CN)

(72) Inventors: Shihui Wu, Suzhou (CN); Zhanguo Liu, Suzhou (CN)

(73) Assignees: Suzhou Opple Lighting Co., Ltd., Suzhou (CN); Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 17/565,051

(22) Filed: Dec. 29, 2021

(65) Prior Publication Data

US 2022/0120396 A1 Apr. 21, 2022

Related U.S. Application Data

(63) Continuation of application No. PCT/CN2020/140218, filed on Dec. 28, 2020.

(30) Foreign Application Priority Data

Dec. 31, 2019 (CN) ..... 201922466844.6

(51) Int. Cl.
*F21S 8/00* (2006.01)
*F21V 7/04* (2006.01)
*F21V 15/01* (2006.01)

(52) U.S. Cl.
CPC ..... *F21S 8/032* (2013.01); *F21V 7/04* (2013.01); *F21V 15/01* (2013.01)

(58) Field of Classification Search
CPC .. F21S 8/032; F21S 8/022; F21V 7/04; F21V 15/01; F21V 7/24; F21V 19/02; F21V 21/04; F21V 3/00; F21V 7/00; F21V 17/12; F21V 21/30; F21V 31/005; F21Y 2115/10
See application file for complete search history.

(56) References Cited

U.S. PATENT DOCUMENTS 7,874,709 B1 * 1/2011 Beadle ..... F21S 8/022 362/427
9,845,928 B1 * 12/2017 Tyson ..... F21V 29/83
10,393,359 B1 * 8/2019 Qi ..... F21V 23/008
(Continued)

FOREIGN PATENT DOCUMENTS

CN 202927623 U 5/2013
CN 203442717 U 2/2014
(Continued)

OTHER PUBLICATIONS

International Search Report of PCT Application No. PCT/CN2020/140218 dated Apr. 2, 2021 with English translation, (4p).

*Primary Examiner* — Tsion Tumebo
(74) *Attorney, Agent, or Firm* — Arch & Lake LLP

(57) ABSTRACT

An underground lamp includes a lamp body, a seal ring, a reflection cup and a panel. The seal ring and a reflection cup provided with a support ring are adopted, and the support ring and the seal ring together support the panel so as to form a buffer space between the panel and the lamp body, thereby reducing the risk of damaging the panel caused by being pressed.

11 Claims, 3 Drawing Sheets

(56) References Cited

U.S. PATENT DOCUMENTS

| | | | | |
|---|---|---|---|---|
| 2008/0186717 | A1* | 8/2008 | Ruberg | F21S 8/022 362/365 |
| 2009/0184646 | A1* | 7/2009 | Devaney | F21V 29/507 445/23 |
| 2016/0025287 | A1* | 1/2016 | Philhower | F21S 8/022 362/183 |
| 2018/0180269 | A1* | 6/2018 | Liu | F21V 21/02 |

FOREIGN PATENT DOCUMENTS

| | | | |
|---|---|---|---|
| CN | 206694982 | U | 12/2017 |
| CN | 107965710 | A | 4/2018 |
| CN | 209229513 | U | 8/2019 |
| CN | 211450608 | U | 9/2020 |

* cited by examiner

UNDERGROUND LAMP

CROSS-REFERENCE TO RELATED APPLICATIONS

This application is a continuation of PCT patent application No. PCT/CN2020/140218 filed on Dec. 28, 2020 which is based upon and claims priority to Chinese patent application No. 201922466844.6 filed on Dec. 31, 2019, the entire contents of which are hereby incorporated by reference herein for all purposes.

TECHNICAL FIELD

The present disclosure relates to a technical field of lighting device, in particular to an underground lamp.

BACKGROUND

Underground lamps are widely used in all kinds of outdoor decorations such as gardens, lawns and the like because of advantages such as space saving and good light emission effect.

Because the height of a panel of an underground lamp usually satisfies that the panel is flush with the ground, the panel is liable to pressure resulting from being treaded or the like and thus has a high risk of breakage after being pressed.

SUMMARY

In a first aspect of the present disclosure, an underground lamp includes a lamp body, a seal ring, a reflection cup and a panel, wherein:

At least one example of the present disclosure provides an underground lamp, the underground lamp comprises a lamp body, a seal ring, a reflection cup and a panel, the lamp body has an installation cavity, the installation cavity has an installation port, the installation port has an installation port outer edge, and the lamp body further has an abutment ring protruding from the installation port outer edge and circumferentially surrounding the installation port; the reflection cup is disposed in the installation cavity, the reflection cup has a light exit cavity opening, the light exit cavity opening has a light exit cavity opening outer edge, the reflection cup further has a support ring protruding from the light exit cavity opening outer edge, the support ring is made of an elastic material, the installation port has an installation port inner edge, and the installation port inner edge has an abutment step circumferentially surrounded by the installation port; the panel covers the abutment ring and is fixed to the lamp body, the seal ring is disposed between the abutment ring and the panel, the seal ring is pressed by the panel and the abutment ring in cooperation, the support ring is disposed between the abutment step and the panel, and the support ring is pressed by the panel and the abutment step in cooperation.

BRIEF DESCRIPTION OF THE DRAWINGS

The drawings described herein are used to provide further understanding of the present disclosure and constitute a part of the present disclosure. Illustrative examples of the present disclosure and description thereof are used to explain the present disclosure, and do not constitute an improper limit to the present disclosure. In the drawings.

DETAILED DESCRIPTION

Figure 1:
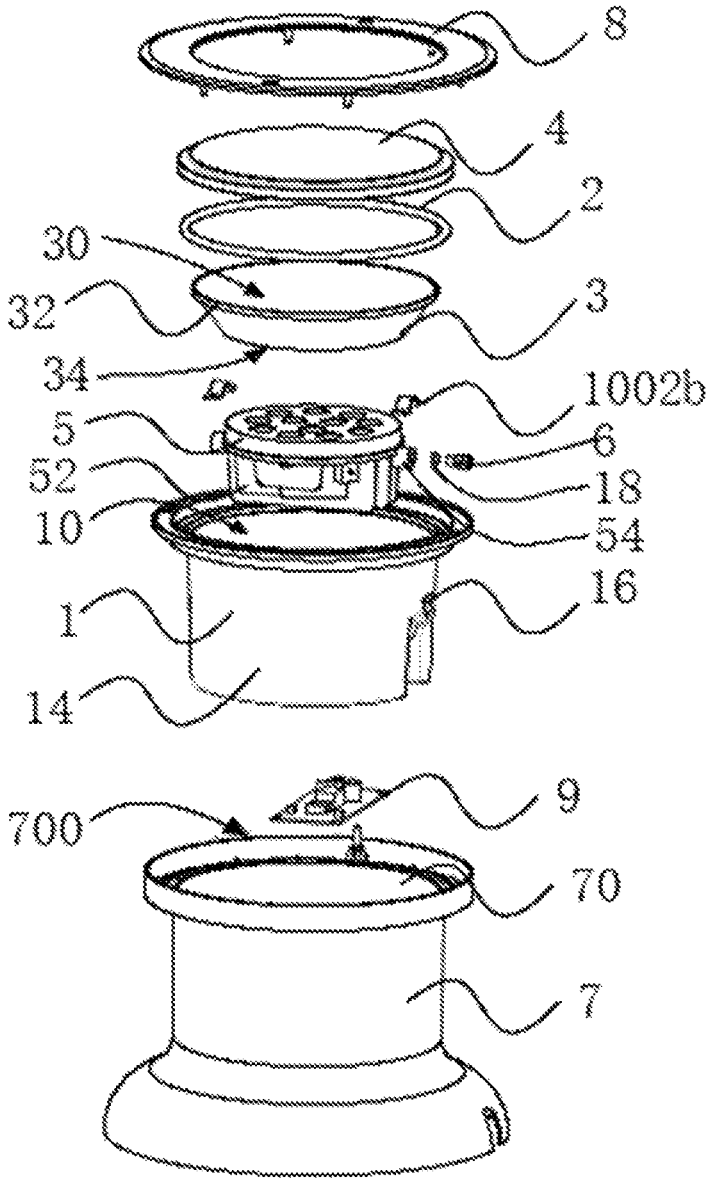
FIG. 1 is a schematic view of members of an underground lamp disclosed by an example of the present disclosure.

In order to make the objective, technical solutions and advantages of the present disclosure more apparent, the technical solutions of the present disclosure will be described clearly and completely with reference to examples of the present disclosure and corresponding drawings hereinafter. It will be apparent that the examples described are only some but not all of the examples of the present disclosure. Based on the examples in the present disclosure, all the other examples obtained by those of ordinary skill in the art without making inventive efforts fall within the scope claimed by the present disclosure.

DESCRIPTION OF REFERENCE NUMERALS

1—lamp body; 2—seal ring; 3—reflection cup; 4—panel; 5—light source assembly; 6—adjustment rod; 7—pre-embedded member; 8—fixture member; 9—power source; 10—installation cavity; 12—abutment ring; 14—outer peripheral surface; 16—adjustment hole; 18—adjustment hole waterproof member; 30—light exit cavity opening; 32—support ring; 34—light entrance cavity opening; 50—light exit surface; 52—light source assembly side surface; 54—rotation shaft; 70—pre-embedded cavity; 100—installation port; 102—inner peripheral surface; 120—installation port inner edge; 122—circular groove; 300—light exit cavity opening outer edge; 700—pre-embedded opening; 1000—installation port outer edge; 1002—rotation shaft cooperation assembly; 1200—abutment step; 1002*a*—U-shaped receiving groove; 1002*b*—damping member; 1200*a*—bearing ring surface.

Hereinafter, the technical solutions provided in examples of the present disclosure will be described in detail with reference to the appended drawings.

Figure 2:
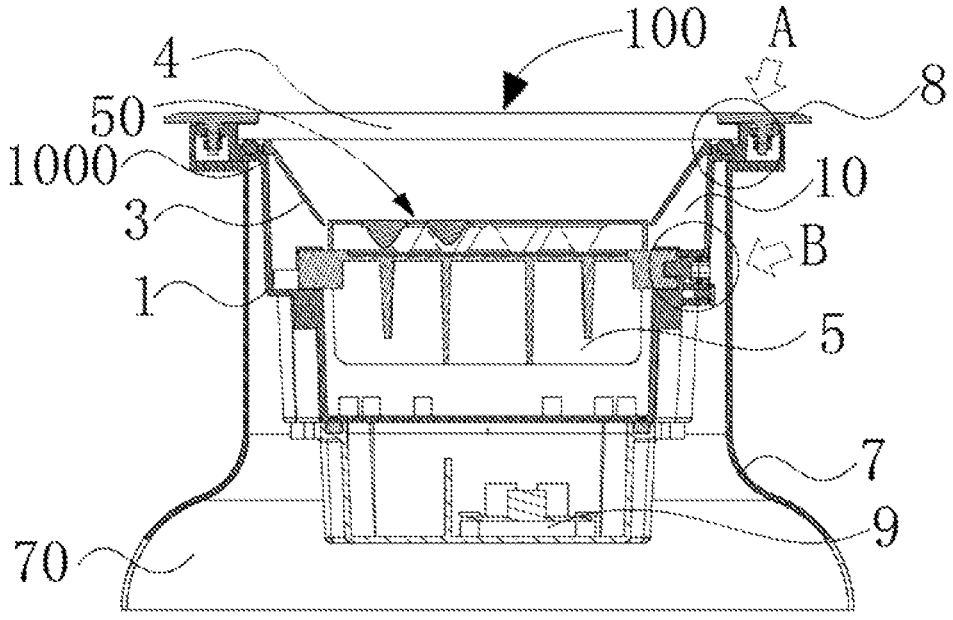
FIG. 2 is a schematic cross-sectional view of an underground lamp disclosed by an example of the present disclosure.

An example of the present disclosure provides an underground lamp. As illustrated in FIG. 1, the underground lamp comprises a lamp body 1, a seal ring 2, a reflection cup 3 and a panel 4. The lamp body 1 further has an installation cavity 10, and the installation cavity 10 has an installation port 100 configured to communicate with an environment outside the installation cavity 10. In this example, the installation cavity 10 is provided as a through cavity as illustrated in FIG. 2, and the installation port 100 is one opening of the installation cavity 10. The installation port 100 may be a round opening as illustrated in FIG. 1, and may also be in other shapes such as a rectangle or a triangle.

In this example, the installation port 100 has an installation port outer edge 1000, and the lamp body 1 has an abutment ring 12 protruding from the installation port outer edge 1000. The installation cavity 10 is configured to accommodate the reflection cup 3, and the abutment ring 12 is configured to cooperate with the panel 4 to clamp the seal ring 2 therebetween. The seal ring 2 may be a gasket circumferentially surrounding the installation port 100 as illustrated in FIG. 1, the abutment ring 12 is provided with a circular groove 122, and the gasket is disposed in the circular groove 122, which can avoid unnecessary displacement of the gasket when the gasket is disposed between the panel 4 and the lamp body 1.

Figure 3:
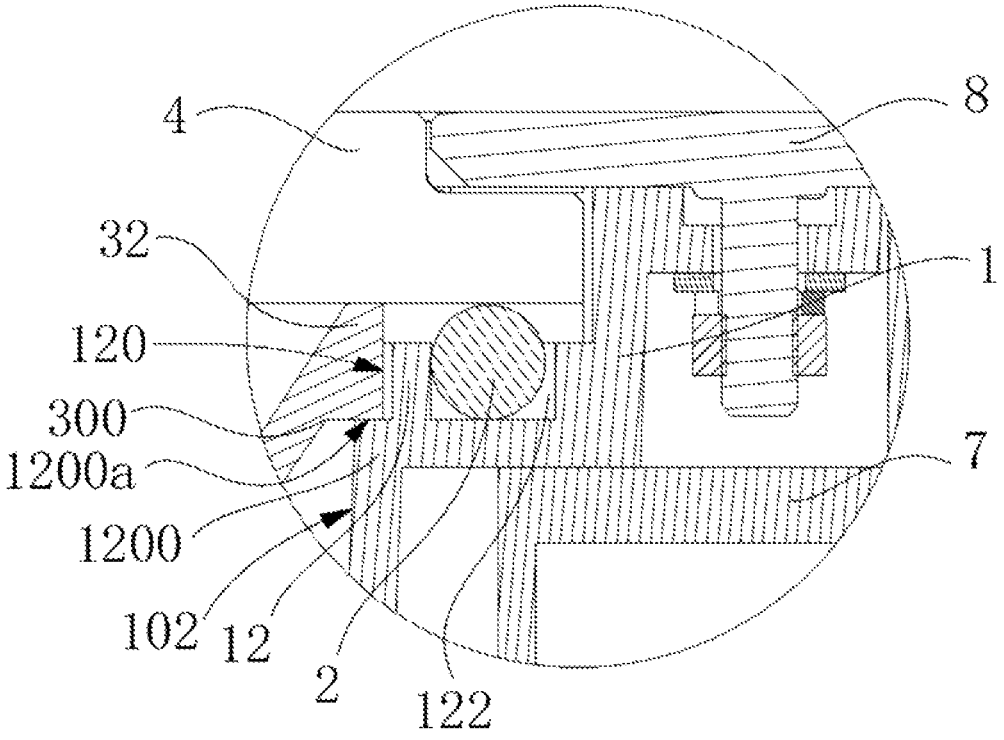
FIG. 3 is a schematic enlarged view of a region A in FIG. 2.

As illustrated in FIG. 3, the abutment ring 12 has an installation port inner edge 120 axially surrounding the installation port 100, the installation port inner edge 120 has an abutment step 1200 protruding from the installation port inner edge 120, and the abutment step 1200 has a bearing ring surface 1200*a* which is configured to support the reflection cup 3 and faces the installation port 100. Both the installation port inner edge 120 and the bearing ring surface 1200*a* may be in a round shape and may also be designed correspondingly according to the shape of the installation port 100.

The bearing ring surface 1200*a* and the installation port inner edge 120, as illustrated in FIG. 3, are perpendicular to each other and together constitute the abutment step 1200 configured to fix the reflection cup 3, and the bearing ring surface 1200*a* and the installation port inner edge 120 may also be disposed to have another angle therebetween. Corresponding to the abutment step 1200, the reflection cup 3 has a light exit cavity opening 30 as illustrated in FIG. 1. The light exit cavity opening 30 has a light exit cavity opening outer edge 300, a support ring 32 protruding from the light exit cavity opening outer edge 300 circumferentially surrounds the light exit cavity opening 30. The abutment step 1200 may fit with the support ring 32 in shape and tightly engaged with the support ring 32 as illustrated in FIG. 3; and the support ring 32 may be disposed to abut against two surfaces of the abutment step 1200 and a gap is provided between the support ring 32 and two surfaces of the abutment step 1200, as long as the reflection cup 3 can be restricted from moving in a vertical direction. In this way, the process of installing the reflection cup 3 can be simplified. The light exit cavity opening 30 has a same orientation as the installation port 100 in order to ensure normal light exit.

In this example, in order to realize that the reflection cup 3 can provide a buffer function for the panel 4, the reflection cup 3 is made of an elastic material, and the elastic material may be rubber or plastic with good elasticity or the like. In this example, both the support ring 32 and the seal ring 2 are disposed to extend beyond the installation port 100 in the orientation of the installation port so that the seal ring 2 and the support ring 32 can be pressed simultaneously when the panel 4 covers the abutment ring 12.

In the present disclosure, the seal ring and the reflection cup with the support ring are adopted, and the support ring and the seal ring together support the panel so as to form a buffer space between the panel and the lamp body, thereby reducing the risk of damaging the panel caused by being pressed.

In this example, the underground lamp further comprises a light source assembly 5. The light source assembly 5 has a light exit surface 50 and a light source assembly side surface 52 surrounding the light exit surface 50. The reflection cup 3 has a light entrance cavity opening 34 opposite to the light exit cavity opening 30 in the orientation of the installation port so that the reflection cup 3 constitutes a through reflection cavity. The light exit surface 50 is towards the light entrance cavity opening 34, so that the light emitted from the light exit surface 50 can enter the reflection cup 3 and be gathered by the reflection cup 3.

In order to achieve the technical effect that the light exit angle of the light source assembly 5 can be adjusted, the light source assembly 5 is provided with a rotation shaft 54 protruding from the light source assembly side surface 52. The rotation shaft 54 may be one rotation shaft 54 protruding from the light source assembly side surface 52 as illustrated in FIG. 1, or two surfaces of the light source assembly side surface 52 departing from each other may be respectively provide with one rotation shaft 54 protruding therefrom, as long as the rotation shaft 54 can cooperate with a rotation shaft cooperation assembly 1002 in the installation cavity 10 and be is driven to rotate to change the included angle between the optical axis of the light source assembly 5 and the orientation of the installation port. The rotation shaft 54 and the rotation shaft cooperation assembly 1002 may be a matching structure of a cylindrical shaft and a circular hole, a structure constituted by a shaft core and a matching bearing or the like.

Figure 4:
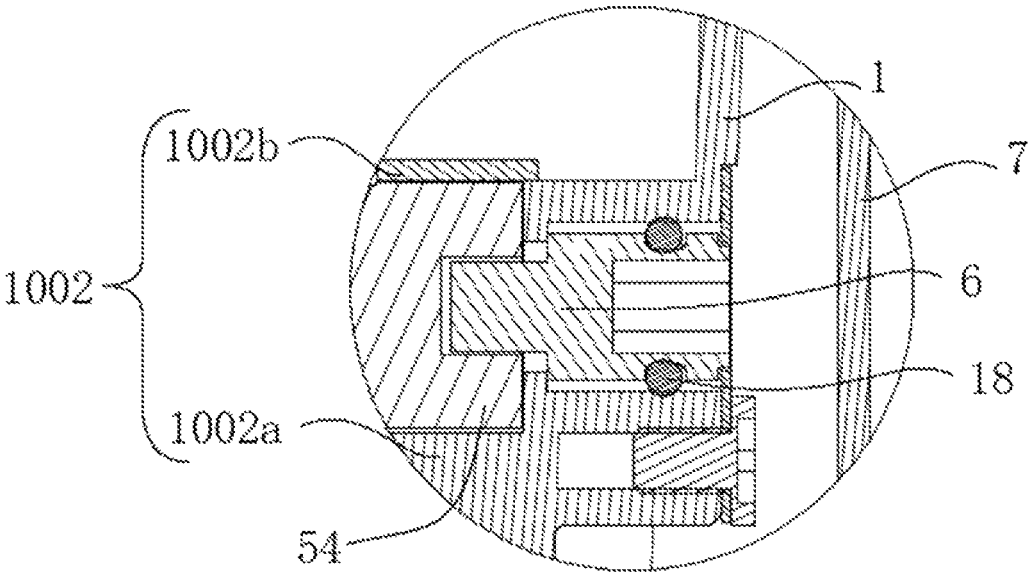
FIG. 4 is a schematic enlarged view of a region B in FIG. 2.

In this example, as illustrated in FIG. 4, the rotation shaft cooperation assembly 1002 is provided with a U-shaped receiving groove 1002*a* and a damping member 1002*b* which can be engaged with each other. After the U-shaped receiving groove 1002*a* and the damping member 1002*b* are engaged with the rotation shaft 54, the damping member 1002*b* provides rotation resistance force to the rotation shaft 54 so that the light emitting direction of the light source assembly 5 can be fixed after being adjusted. In this example, the damping member 1002*b* can effectively provide the rotation resistance force, and the depth of the U-shaped receiving groove 1002*a* is not greater than the diameter of the rotation shaft 54. In this way, the damping member 1002*b* can be in an inverted U-shape as illustrated in FIG. 1 or other shapes that help to provide the rotation resistance force. In this example, the damping member 1002*b* may be a fixed member having a rough friction surface, or may have occlusal teeth protruding from a surface facing the rotation shaft 54 of the damping member 1002*b*, to provide a friction force by the occlusal teeth.

For easy adjustment of rotation of the rotation shaft 54, in this example, as illustrated in FIG. 1, the lamp body 1 has an outer peripheral surface 14 circumferentially surrounding the installation port 100, the installation cavity 10 has an inner peripheral surface 102, and the lamp body 1 has an adjustment hole 16 penetrating through the outer peripheral surface 14 and the inner peripheral surface 102 in order to enable an external operation to be accessed by the internal rotation shaft 54. In the example illustrated in FIG. 4, because the rotation shaft 54 is disposed in the U-shaped receiving groove 1002*a*, an opening of the adjustment hole 16 is provided on a side wall of the U-shaped receiving groove 1002*a*. If the rotation shaft 54 is disposed at other positions, the position of the adjustment hole 16 should be changed correspondingly as long as the adjustment hole 16 is disposed coaxially with the rotation shaft 54.

In order to adjust the rotation attitude of the rotation shaft 54, as illustrated in FIG. 4, the underground lamp according to the example of the present disclosure further comprises an adjustment rod 6, which is configured to penetrate through the adjustment hole 16 and drive the rotation shaft 54 to rotate. In this example, the rotation shaft 54 may be provided with a hexagonal hole coaxial therewith attitude, and one end of the adjustment rod 6 is in a hexagon shape correspondingly. Thus, the adjustment rod 6 can drive the rotation shaft 54 to rotate after being inserted into the hexagonal hole. The adjustment rod 6 may also be provided with a clamping portion as long as the adjustment rod 6 can drive the rotation shaft 54 to rotate.

Forming the adjustment hole 16 in the lamp body 1 destroys the water resistance ability of the lamp body 1. Therefore, in order to solve this problem, in this example, as illustrated in FIG. 4, the lamp body 1 further comprises an adjustment hole waterproof member 18, and the adjustment hole waterproof member 18 is disposed in a gap between the adjustment rod 6 and the adjustment hole 16 and fills the gap, for example fills to the full, in the circumferential direction. The adjustment hole waterproof member 18 may be a rubber ring or foamed plastic which can prevent external water from entering the lamp body 1 through the adjustment hole 16.

For easy installation of the lamp body 1, in this example, as illustrated in FIG. 1, the underground lamp further comprises a pre-embedded member 7 and a fixture member 8. The pre-embedded member 7 has a pre-embedded cavity 70, the pre-embedded cavity 70 has a pre-embedded opening 700, and an orientation of the pre-embedded opening 700 is same as the orientation of the installation port. Taking installation of the underground lamp into the ground as an example, a sufficiently large hole may be excavated in the ground, the pre-embedded member 7 is firstly embedded in the hole with the pre-embedded opening 700 being exposed to the ground; then, the structures such as the lamp body 1 are installed into the pre-embedded cavity 70 through the pre-embedded opening 700 and are fixed; then, the fixture member 8 is fixed to the lamp body 1 by means of bolting, adhesive fixing or the like, and the panel 4 is pressed and fixed on the lamp body 1 with the pressing force which is towards the installation port 100. At the same time, the fixture member 8 extends in a direction away from the axis and covers the pre-embedded opening 700. Thus, the two purposes, i.e., fixing the panel 4 and shielding the pre-embedded opening 700, can be achieved simultaneously by one-time installation, thereby achieving easy installation. The fixture member 8 may be a fixture ring as illustrated in FIG. 1, and the fixture ring covers the periphery of the panel 4 while covering the pre-embedded opening 700. The fixture member 8 may also be a transparent cover which can press the panel 4 and shield the pre-embedded opening 700 at the same time, thereby simplifying the structure while ensuring the waterproof performance.

In this example, in order to supply power to the light source assembly, the underground lamp further comprises a power source 9. The power source 9 may be disposed at the bottom of the lamp body 1 as illustrated in FIG. 1, or may be disposed at other parts of the pre-embedded cavity 70.

To sum up, in the present disclosure, the seal ring and the reflection cup provided with the support ring are adopted, and the support ring and the seal ring together support the panel so as to form a buffer space between the panel and the lamp body, thereby reducing the risk of damaging the panel caused by being pressed.

Preferably, the seal ring is made of a rubber material.

Preferably, the abutment ring is provided with a hollow circular groove circumferentially surrounding the installation port, an orientation of an opening of the circular groove is same as an orientation of the installation port, and the seal ring is disposed in the circular groove.

Preferably, the underground lamp further comprises a light source assembly, the light source assembly has a light exit surface and a light source assembly side surface circumferentially surrounding the light exit surface, the reflection cup has a light entrance cavity opening opposite to the light exit cavity opening, and the light exit surface is towards the light entrance cavity opening; the light source assembly has a rotation shaft which protrudes from the light source assembly side surface; the installation cavity has a rotation shaft cooperation assembly corresponding to the rotation shaft assembly, and the light source assembly is configured to change an included angle between an optical axis of the light source assembly and the orientation of the installation port through cooperation of the rotation shaft assembly and the rotation shaft cooperation assembly.

Preferably, the rotation shaft cooperation assembly comprises a U-shaped receiving groove configured to receive the rotation shaft and a damping member matched with the U-shaped receiving groove, an orientation of an opening of the U-shaped receiving groove is towards the installation port, and a depth of the U-shaped receiving groove in the orientation of the installation port is not greater than a diameter of the rotation shaft; the damping member covers the rotation shaft in the orientation of the opening of the U-shaped receiving groove and is fixed to the U-shaped groove, and the damping member is configured to provide rotation resistance to the rotation shaft.

Preferably, the underground lamp further comprises an adjustment rod, wherein the lamp body has an outer peripheral surface circumferentially surrounding the installation port, the installation cavity has an inner peripheral surface, the lamp body further has an adjustment hole penetrating through the outer peripheral surface and the inner peripheral surface, the adjustment hole is coaxial with the rotation shaft, and the adjustment rod penetrates through the adjustment hole and drives the rotation shaft to rotate coaxially with the adjustment rod.

Preferably, the underground lamp further comprises an adjustment hole waterproof member, wherein a gap is between the adjustment rod and the adjustment hole, and the adjustment hole waterproof member is disposed in the gap and circumferentially fills the gap.

Preferably, the underground lamp further comprises a pre-embedded member and a fixture member, wherein the pre-embedded member has a pre-embedded cavity, the pre-embedded cavity has a pre-embedded opening, an orientation of the pre-embedded opening is same as the orientation of the installation port, the lamp body is fixed in the pre-embedded cavity, the fixture member is configured to fix the panel to the lamp body and applies to the panel a pressing force towards the installation port, and the fixture member extends in a direction away from the installation port and covers the pre-embedded opening.

Preferably, the fixture member is a fixture ring, and the fixture ring covers a periphery of the panel.

The seal ring and the reflection cup provided with a support ring are adopted in the present disclosure, and the support ring and the seal ring together support the panel so as to form a buffer space between the panel and the lamp body, thereby reducing the risk of damaging the panel caused by being pressed.

The above mentioned examples of the present disclosure focus on the differences between the various examples, and different optimization features between the various examples may be combined to form a more preferred example as long as they are not contradictory. For simplicity of the text, it will not be repeated herein.

The descriptions above are only examples of the present disclosure, but are not intended to limit the present disclosure. Various modifications and changes can be made to the present disclosure for those of skill in the art. Any modifications, equivalents, improvements and the like made within the spirit and the principle of the present disclosure shall all be covered within the scope of the claims of the present disclosure.

The invention claimed is:

1. An underground lamp, comprising:

a lamp body, a seal ring, a reflection cup and a panel, wherein:

the lamp body has an installation cavity, the installation cavity has an installation port, the installation port has an installation port outer edge, and the lamp body further has an abutment ring protruding from the installation port outer edge and circumferentially surrounding the installation port;

the reflection cup is disposed in the installation cavity, the reflection cup has a light exit cavity opening, the light exit cavity opening has a light exit cavity opening outer edge, the reflection cup further has a support ring protruding from the light exit cavity opening outer edge, the support ring is made of an elastic material, the installation port has an installation port inner edge, and the installation port inner edge has an abutment step circumferentially surrounded by the installation port; and the panel covers the abutment ring and is fixed to the lamp body, the seal ring is disposed between the abutment ring and the panel, the seal ring is pressed by the panel and the abutment ring in cooperation, the support ring is disposed between the abutment step and the panel, and the support ring is pressed by the panel and the abutment step in cooperation, wherein the rotation shaft cooperation assembly comprises a U-shaped receiving groove configured to receive the rotation shaft and a damping member matched with the U-shaped receiving groove, wherein the damping member is circular and cross section of the damping member is of inverted U-shape.

2. The underground lamp of claim 1, wherein the seal ring is made of a rubber material.

3. The underground lamp of claim 1, wherein the abutment ring is provided with a hollow circular groove circumferentially surrounding the installation port, an orientation of an opening of the circular groove is same as an orientation of the installation port, and the seal ring is disposed in the circular groove.

4. The underground lamp of claim 1, further comprising a light source assembly, wherein the light source assembly has a light exit surface and a light source assembly side surface circumferentially surrounding the light exit surface, the reflection cup has a light entrance cavity opening opposite to the light exit cavity opening, and the light exit surface is towards the light entrance cavity opening;

the light source assembly has a rotation shaft which protrudes from the light source assembly side surface; and the installation cavity has a rotation shaft cooperation assembly corresponding to the rotation shaft assembly, and the light source assembly is configured to change an included angle between an optical axis of the light source assembly and the orientation of the installation port through cooperation of the rotation shaft assembly and the rotation shaft cooperation assembly.

5. The underground lamp of claim 4, wherein an orientation of an opening of the U-shaped receiving groove is towards the installation port, and a depth of the U-shaped receiving groove in the orientation of the installation port is not greater than a diameter of the rotation shaft; and wherein the damping member covers the rotation shaft in the orientation of the opening of the U-shaped receiving groove and is fixed to the U-shaped groove, and the damping member is configured to provide rotation resistance to the rotation shaft.

6. The underground lamp of claim 4, further comprising an adjustment rod, wherein the lamp body has an outer peripheral surface circumferentially surrounding the installation port, the installation cavity has an inner peripheral surface, the lamp body further has an adjustment hole penetrating through the outer peripheral surface and the inner peripheral surface, the adjustment hole is coaxial with the rotation shaft, and the adjustment rod penetrates through the adjustment hole and drives the rotation shaft to rotate coaxially with the adjustment rod.

7. The underground lamp of claim 6, further comprising an adjustment hole waterproof member, wherein a gap is between the adjustment rod and the adjustment hole, and the adjustment hole waterproof member is disposed in the gap and circumferentially fills the gap.

8. The underground lamp of claim 1, further comprising a pre-embedded member and a fixture member, wherein the pre-embedded member has a pre-embedded cavity, the pre-embedded cavity has a pre-embedded opening, an orientation of the pre-embedded opening is same as the orientation of the installation port, the lamp body is fixed in the pre-embedded cavity, the fixture member is configured to fix the panel to the lamp body and applies to the panel a pressing force towards the installation port, and the fixture member extends in a direction away from the installation port and covers the pre-embedded opening.

9. The underground lamp of claim 8, wherein the fixture member is a fixture ring, and the fixture ring covers a periphery of the panel.

10. The underground lamp of claim 1, wherein the abutment step has a bearing ring surface, wherein the bearing ring surface and the installation port inner edge are perpendicular to each other.

11. The underground lamp of claim 3, wherein cross section of the circular groove is rectangular and cross section of seal ring is circular.

* * * * *